United States Patent [19]

Riley

[11] Patent Number: 4,645,252

[45] Date of Patent: Feb. 24, 1987

[54] ANIMAL DROPPING TOOL

[76] Inventor: Mike Riley, 801 Fourth St., NE., Minneapolis, Minn. 55413

[21] Appl. No.: 850,223

[22] Filed: Apr. 10, 1986

[51] Int. Cl.[4] ..... A01K 29/00

[52] U.S. Cl. ..... 294/1.4; 294/33

[58] Field of Search ..... 294/1.3–1.5, 294/19.1, 22–24, 27.1, 29, 32, 33, 55, 99.1; 15/257.1, 257.7; 248/312.1, 313

[56] References Cited

U.S. PATENT DOCUMENTS

| | | | |
|---|---|---|---|
| 618,048 | 1/1899 | Anderson | 15/257.7 |
| 775,663 | 11/1904 | Macfarlane | 294/33 |
| 1,377,350 | 5/1921 | Hoskin | 294/33 |
| 3,610,671 | 10/1971 | Conger | 294/33 |
| 3,767,246 | 10/1973 | Corelli et al. | 294/1.5 |
| 3,786,780 | 1/1974 | Pezzino | 294/1.5 |
| 3,819,220 | 6/1974 | Bredt | 294/1.5 |
| 3,830,423 | 8/1974 | Prescott | 294/1.3 |
| 3,910,619 | 10/1975 | Schmieler | 294/1.4 |
| 4,466,648 | 8/1984 | Albiez | 294/1.4 |

*Primary Examiner*—Johnny D. Cherry
*Attorney, Agent, or Firm*—Vidas & Arrett

[57] ABSTRACT

A device for sanitary removal of fecal matter from surfaces. The device includes a cup-holding frame and an elongated handle. A disposable cup is held to the frame from its rear, sides and lip such that a portion of the cup may contact fecal matter without simultaneously soiling the device.

10 Claims, 5 Drawing Figures

ANIMAL DROPPING TOOL

DESCRIPTION

1. Field of the Invention

The present invention relates to a device for the sanitary pick up of fecal matter of animals. More particularly, the device consists of a cup holding member having an elongated arm which may be used with an ordinary disposable drinking cup.

2. Background of the Invention

Our pets and particularly dogs present owners and non-owners alike with a problem of disposing of fecal matter. Authorities in many communities have enacted ordinances requiring owners or handlers to clean up after their pets or be subject to heavy fines. These ordinances attempt to keep parks clean of fecal matter and diseases associated with animal waste. The problem is very severe in many cities. The owners themselves are faced with the additional problem of picking up and disposing of fecal matter deposited in their own yards.

Various devices or tools to aid in the cleaning process have been proposed. However, such devices leave much to be desired. Many of the tools are in the nature of a scoop for shoveling the feces or tongs for grasping the feces. Such tools are, unfortunately, subject to becoming soiled in use and must be cleaned after each use. Of course, a person walking a dog in a park has no readily available facilities for cleaning the soiled tool. Therefore, many owners will risk the imposition of a fine rather than carry a feces contaminated tool.

For home use a shovel or shovel-like device is relatively effective but must still be rinsed off after each job. In addition, shovel-like devices require another bag or receptacle for the disposable of fecal material. If the feces are not removed daily flies will land on the fecal material and tend to communicate and spread disease.

Many devices have been patented and marketed which allow dog owners to scoop up the droppings which have been deposited on the ground or to catch the excrement as it falls from the dog. Many of the devices are very awkward and require the use of two hands and all involve the risk of soiling the tool itself even if a disposable receptacle is provided. Devices such as those shown in U.S. Pat. Nos. 3,767,246, 3,786,780, and 3,819,220 all involve a disposable receptacle which must be positioned under the dog while it defecates. Anyone who has watched a dog defecate realizes that this can be a difficult procedure let alone the embarrassment it causes.

More recently, devices have been described in which the feces is picked up from the ground. Such devices require enough rigidity to be able to slip a portion of the device between the ground and fecal matter.

In U.S. Pat. No. 4,500,125 a combination is shown in which a scoop picks up the fecal matter and deposits it into a plastic sandwich bag which is held open by a frame. Again, the scoop must be cleaned after each use.

The device shown in U.S. Pat. No. 4,466,648 is another recent example of the current state of the art in collecting feces. Feces are picked up by pressing the matter through a mesh element which may then be wrapped into a bag. However, such devices are still objectionable since they must be cleaned after use. To the user, even a small amount of fecal material on the edge of their tool is highly objectionable since the devices cannot be stored or carried under an arm until they are cleaned.

BRIEF SUMMARY OF THE INVENTION

The present invention provides a device for pet owners who are concerned about the spread of disease and parasites through the accumulation of pet feces. The device also enables pet owners to collect fecal samples in a sanitary manner. The tool is especially useful in collecting stool samples for veterinary analysis. A unique feature of the invention is that it utilizes commonly available disposable cups having plastic lids. The cups are held to the device of the invention in such a way that a portion of the cup may be dragged across the ground to pick up the fecal material without the tool itself ever contacting or becoming soiled by the feces.

The device preferably has an elongated handle similar to a golf putter. The handle in turn is attached to a frame which has a pair of arcuate lateral support springs mounted thereto such that they can fit up against a cup lip to hold a standard drinking cup. A coil spring on the rear of the frame supplies pressure to the rear bottom of the cup. A lip engaging hook attached to the frame holds the lip of a cup and together with a rear coil spring firmly wedges the cup to the device. The rear coil also provides leverage to keep the cup in place during use. Preferably, the frame includes a drag weight towards the front adjacent the lateral support springs to provide a slight heft to the tool. The weight acts as a ballast.

To use the device a readily available disposable cup of varying sizes may be inserted into the device by pinching the cup slightly, sliding it through the lateral support springs and up against the coil spring. The rear coil spring is then opened to allow the cup to engage the lip hook. When the coil spring is released it wedges the cup to the frame and hook.

The device may then be used to pick up fecal material from any surface. Since the lateral support springs do not completely encircle the disposable cup, the cup itself may be dragged across the ground until it scoops the feces. When used properly only the interior of the cup will be contaminated by picking up the feces. If the fecal material being picked up has poor consistency, only the exterior surface of the cup which contacts the ground will become contaminated. No part of the device itself ever can contact the ground or the fecal matter being picked up. The cup may then be removed from the tool, capped with a lid and disposed. The clean tool is then ready for another use. During the interim, the clean tool carries no offensive smell or feces which can contact the owner or his belongings.

BRIEF DESCRIPTION OF THE DRAWINGS

A detailed description of the invention is hereafter described with specific reference being made to the drawings in which.

DETAILED DESCRIPTION OF THE INVENTION

Figure 1:
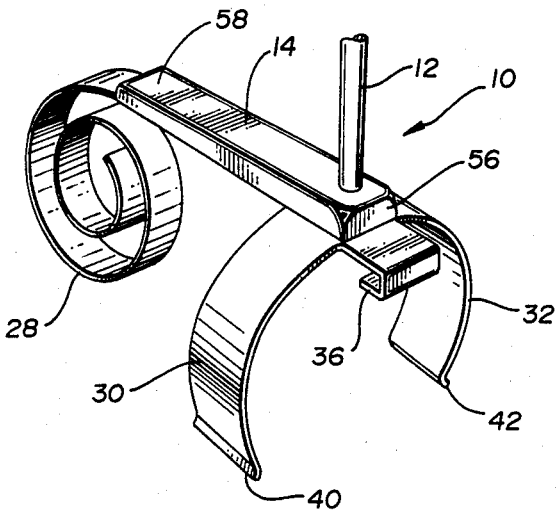
FIG. 1 is an enlarged partial perspective view of the device of the invention without a cup loaded thereto.

With reference to the figures it will be seen that the animal dropping tool 10 of the invention includes an elongated shaft 12 which is attached to frame 14 which holds a disposable cup 16 thereto.

The cups which are usable on this invention include all cups which have a bottom 18, side walls 20, and a lip 22. Preferably, the cups are waterproof or at least water resistant. Most preferably, the cups are any of the commercial cold drink cups currently in use which may be utilized with a plastic lid (not shown). Standard 16 oz., 20 oz., and 32 oz. cold drink cups which are sold in stores and served at fast food restaurants are all usable in this invention.

Tool 10 is designed to hold a cup 16 as shown in the figures. Cup 16 is held to frame 14 by the combination of a rear coil spring 28, a pair of lateral arcuate support springs 30, 32, and a lip hook 36.

Figure 5:
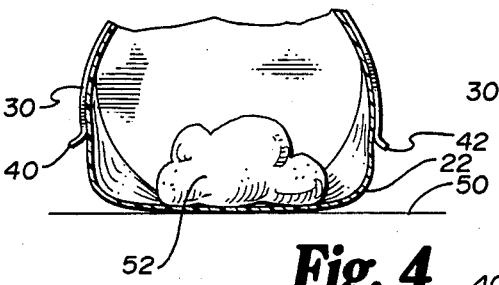
FIG. 5 is a partial front end view of the device loaded with a cup about to be used.

Arcuate support springs 30, 32 are attached to frame 14 and describe a semicircle into which a cup may be inserted. The semicircle described by the arcuate support springs should be at least 180 degrees and less than about 320 degrees. Such an arc insures that a cup fitted with its lip 22 adjacent to springs 30, 32 will be reinforced and stabilized. Also, ends 40, 42 of arcuate support springs 30, 32 will be spaced well away from the edge of the cup opposite frame 14. This insures that when a cup loaded within the tool is scraped across the ground 50 towards fecal material 52, the ends 40, 42 of support springs 30, 32 will not contact ground 50 or fecal material 52. Even if the cup is pressed against the ground and slightly deformed as shown in FIG. 5, the ends of the arcuate support springs will not contact either the ground or the fecal material adjacent the cup opening. In the most preferred form arcuate support springs 30, 32 describe an arc of about 230 degrees which provides excellent securement to the cup and provides a large clearance between ends 40, 42 from the portion of the cup which contacts the ground.

A tongue or lip hook 36 is attached to the front 56 of frame 14. Hook 36 when positioned over loop 22 of a cup 16 prevents the cup from moving towards the front 56 of the frame.

Figure 2:
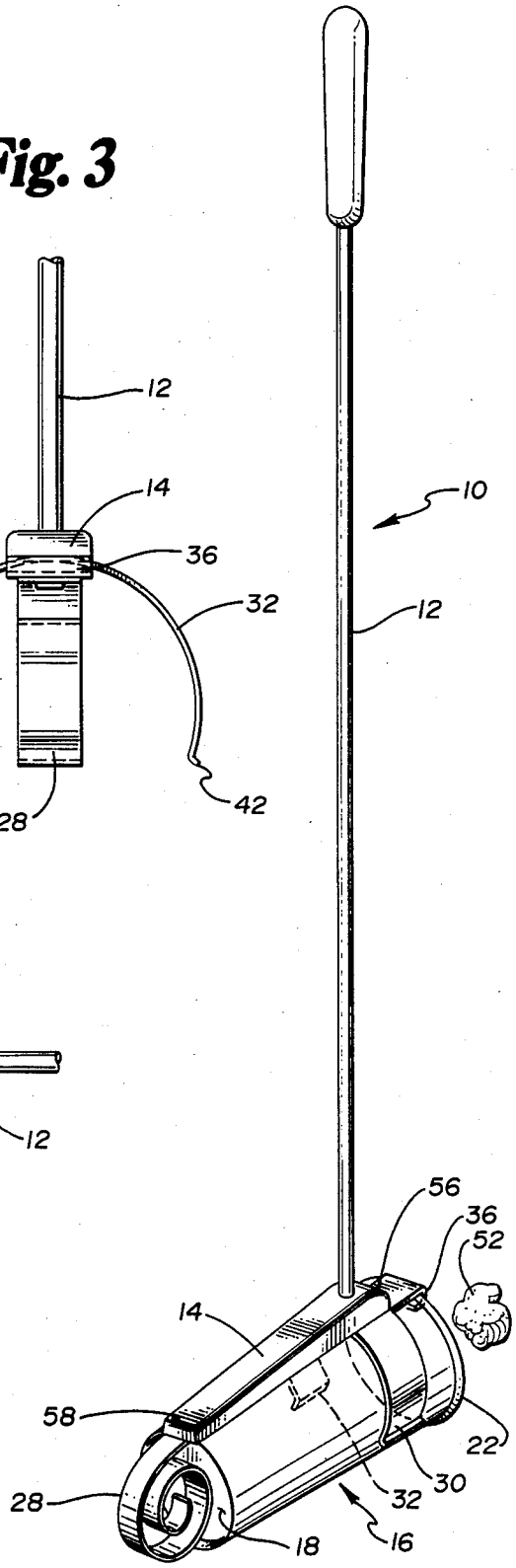
FIG. 2 is a perspective view of the invention showing a cup loaded to the device.
Figure 3:
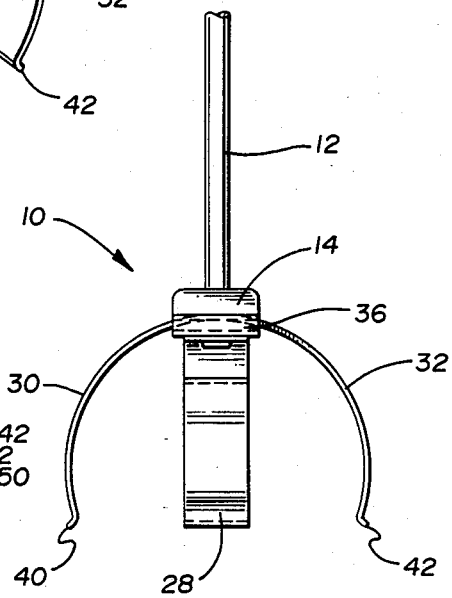
FIG. 3 is the front end view of the device; and with portions of a cup shown in phantom.
Figure 4:
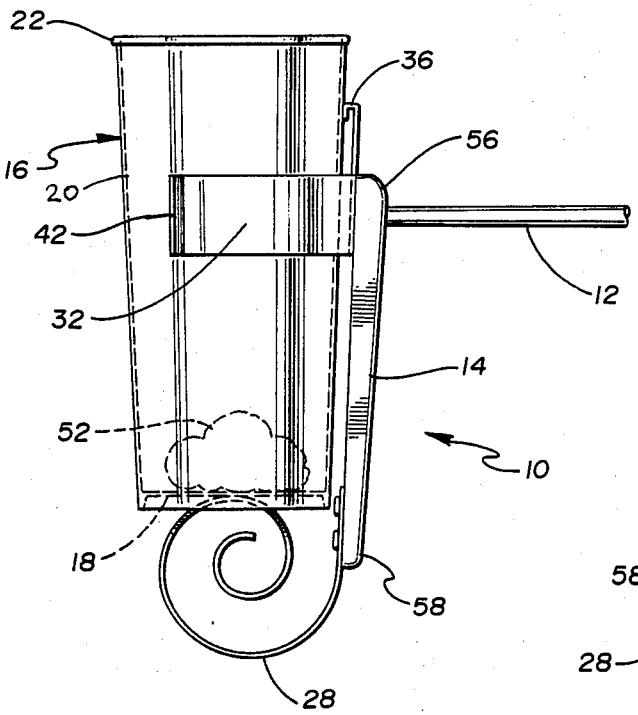
FIG. 4 is a side view of the device of the invention in which the cup is released from the lip hook.

The coil spring 28 is attached to the rear 58 of frame 14 as best shown in FIGS. 1, 2, and 4. Coil spring 28 is constructed and arranged to provide an upward pressure directed towards the front end of the frame. Coil spring 28 contacts the bottom 18 of the cup 16 and urges the cup upwardly against hook 36. The combined action of hook 36 and coil spring 28 wedges the cup in place and provides leverage to keep the cup in place during use.

A cold drink cup 16 may be loaded into the tool 10 by pinching the cup slightly so that it may be more easily slid through the opening defined by supports frames 30, 32. The rear coil spring 28 is then opened so that the cup can be depressed backwardly until it clears the end of hook 36. Releasing the coil spring 28 forces the cup upwardly into engagement with hook 36 which firmly secures the cup to the tool.

With the aid of elongated shaft 12 tool 10 may be used in the manner similar to that of putting a golf ball. The shaft may be angled like a golf putter. Waste materials that roll can be scooped up by increasing the pitch of the shaft 12 and by slightly increasing the pressure applied to the lip of cup 16. After use, the cup is disengaged from hook 36 by pressing downwardly upon a clean portion of lip 22 of cup 16. Spring 28 pushes cup 16 forwardly as shown in FIG. 4. The user can then either discard the cup and its contents or may place a lid over the lip of the cup to seal the feces therewithin. Tool 10 which has never touched fecal material 52 during use is ready for another application. Tool 10 of the invention picks up and disposes of fecal material in one cup and in one procedure. No washing of the tool is required nor is there a need to transfer the fecal material to any other receptacle for disposal. Another advantage of the tool of the invention is that it provides an owner with a perfect container to take a fecal sample to a veterinarian for analysis. Since the first signs of illness in pets often appears in stool samples, periodic checks are vital to maintain good health. This is especially useful when a dog is suspected of having worms.

The rear coil spring 28 allows the use of a wide variety of cup sizes. When a shorter cup is utilized, coil spring 28 merely extends further towards support springs 30, 32. In this manner tool 10 may be utilized with any ordinary cup the user is able to find when the tool is needed. Discarded cold drink cups in waste receptacles may be utilized so the dog owner would not have to carry a clean cup with the tool.

Although it is best to utilize a cup having a rolled lip 22, a rolled lip is not critical. The advantage of the rolled lip is that it provides cups with increased rigidity especially when arcuate support rings 30, 32 are positioned near lip 22 as shown in FIG. 1. For cups having a stiffness significantly greater than ordinary drinking cups, it is positioned to use a device having arcuate support springs that define an arc of less than 180 degrees since less stiffening of the cup would be required. However, for maximum utility device 10 should include longer support springs to eliminate the need for specially manufactured cups.

Although tool 10 is shown with a simple elongated shaft 12, nearly any shaft may be utilized. For example, the shaft may be threaded to the frame, may be telescopic so as to collapse to a minimal space and the like.

In order to provide a simple, relatively lightweight device, a cup is held between the coil spring, support springs, and lip hook. Forms in which pressure is applied to a bottom of a cup through a spring member which is not a coil spring are within the spirit of this invention. Likewise, the support springs are intended to provide stiffening and lateral support to a cup inserted within tool 10. The spirit of this invention would also include lateral curved supports which open and close in response to a tong mechanism. Suitable tong mechanisms are shown in U.S. Pat. Nos. 3,841,686 and 4,248,468.

In considering this invention it must be remembered that the disclosure is illustrative only and that the scope of the invention is to be determined only by the appended claims.

What is claimed is:

1. A device for picking up animal feces in combination with a cup, the device comprising:

a frame member having a top, bottom and front and back ends;

(b) an elongated handle detachably connected to said frame member;

(c) a pair of arcuate support springs, each having a convex face, said springs each being attached at one end to said frame member in a spaced opposing relation such that the convex faces of said springs face each other so as to define an opening and together with the frame member define an arc of greater than about 180 degrees and less than about 320 degrees;

(d) a coil sring member attached to the back end of said frame member and being constructed and arranged such that it is normally biased toward the opening defined by said arcuate support springs; and (e) lip securement means attached to said frame member for engaging and holding a lip of a cup inserted between said arcuate springs when the bottom of said cup contacts said coil spring member said lip securement means being constructed and arranged such that a cup lip is held to the front end of said frame member and the other portions of said lip may contact fecal matter without feces touching said lip securement means.

2. A device for disposing of animal feces comprising;

(a) an elongated handle;

(b) a frame member detachably connected to said handle;

(c) a pair of arcuate arms attached to said frame member and being spaced from each other so as to define a semicircular opening through which a cup may be inserted;

(d) cup pressure means attached to said frame member for applying pressure against the bottom of a cup held between said arcuate arms so as to urge said bottom toward said arcuate arms; and (e) lip securement means for engaging and holding a lip of a cup inserted between said arcuate arms when the bottom of said cup is urged toward said arcuate arms by said cup pressure means, said lip securement means being constructed and arranged such that it contacts only the cup lip adjacent said frame member such that the cup lip opposed from the frame may contact fecal matter without feces contacting said device.

3. A device for disposing of fecal matter comprising:

(a) an elongated handle;

(b) frame means for holding a disposable drinking cup of the type having a bottom, sides, and a lip thereto, said frame means comprising:

(c) cup lid engaging means for engaging a lip of a cup held to said frame means;

(d) cup bottom engaging means for urging the bottom of a cup held to said frame means against said cup lip engaging means such that such a cup is fixedly held to said frame means; and (e) cup support means for providing lateral support to a cup held to said frame means; said cup support means comprising a pair of arcuate support members attached to said frame means and being in a spaced, oposing relationship to each other such that a seimicircular opening is thereby defined; said cup support means and cup lip engaging means being constructed and arranged so as to contact only a portion of said cup such that fecal matter may contact a side of a cup without contacting any portion of said device.

4. The device of claim 3 wherein said cup bottom engaging means comprises a spring which is constructed and arranged such that said spring urges a cup held by said frame means toward said lip engaging means.

5. The device of claim 4 wherein said cup lip engaging means comprises a hook shaped member which limits the travel of a cup held by said frame means from said cup bottom engaging means.

6. The device of claim 5 wherein said arcuate support members are springs constructed and arranged such that said members hold the sides of a cup inserted therein.

7. The device of claim 6 wherein said arcuate support members define a semicircle having an arc of greater than 180 degrees and less than about 320 degrees.

8. The device of claim 7 wherein said arcuate support members define a semicircle having an arc of between about 230 degrees and about 280 degrees.

9. A device for the sanitary handling of animal feces in conjunction with a disposable cup of the type having a bottom, sides and a lip, the device comprising:

(a) a frame member having first and second ends;

(b) spring means adjacent the first end of said frame member for supplying pressure against the bottom of a cup;

(c) lip engaging means adjacent the second end of said frame member for engaging the lip of a cup;

(d) a pair of arcuate arm members attached to said frame member such that a semicircular cup receiving a channel is defined therebetween; and (e) an elongaed handle attached to said frame member.

10. Apparatus of holding a disposable, semi-rigid container having an open end including a lip portion for receiving animal feces, said container having at least a portion of the side wall defining a recessed region, said apparatus comprising:

(a) an elongated frame member, having first and second remote ends;

(b) handle means joined to said frame member and extending outwardly relative to a first side of said frame member;

(c) container engaging means joined to said frame member and extending outwardly therefrom in a direction generally opposite to that of said handle means, said container engaging means being spaced apart and in generally the same plane so as to define between them a container receiving space, the ends of said container engaging means opposite the end joining said container engaging means being constructed and arranged to press against a lateral side wall recessed region of said container to restrict movement of said container in the plane of said engaging means;

(d) lip portion engaging tang means joined to the first end of said frame member, and extending outwardly therefrom in the same general direction as said engaging means for engaging the lip of a container; and (e) spring biasing means joined to the second end of said frame member and extending outwardly therefrom in the same general direction as said engaging means and providing a surface for engaging the closed end of said container so that the lip portion is in locked relationship with said tang means when joined to said apparatus.

* * * * *